United States Patent [19]

Mocco

[11] 4,316,586

[45] Feb. 23, 1982

[54] PROCESS FOR WINDING, ON A TAKE-UP SHAFT, A SHEET MATERIAL FED FROM A SUPPLY SOURCE

[76] Inventor: Henri A. Mocco, 95, Ave. Mahieu, 94100 Saint-Maur des Fosses, France

[21] Appl. No.: 170,708

[22] Filed: Jul. 21, 1980

[30] Foreign Application Priority Data

Jul. 27, 1979 [FR] France ..... 79 19455

[51] Int. Cl.[3] ..... B65H 17/08

[52] U.S. Cl. ..... 242/65; 242/67.1 R

[58] Field of Search ..... 242/66, 65, 67.1 R, 242/67.2, 67.3 R, 75

[56] References Cited

U.S. PATENT DOCUMENTS

| | | | |
|---|---|---|---|
| 2,196,000 | 4/1940 | Richardson | 242/65 |
| 2,683,917 | 7/1954 | Farst | 242/65 X |
| 2,777,644 | 1/1957 | Nicholson | 242/65 |
| 3,825,197 | 7/1979 | Sturgern | 242/75 |

*Primary Examiner*—Edward J. McCarthy

[57] ABSTRACT

A process for winding, on a take-up shaft, a sheet material fed from a supply source, for example a strip of aluminum, paper, cardboard, etc. coming from a wider strip cut longitudinally. The sheet of material is taken up on an idler shaft driven by means of a bearing drive cylinder rotating at the same linear speed as the feeder. The linear speed identity between the bearing cylinder and the feeder is obtained by driving the bearing cylinder by an adjustable friction means driven at an overspeed by a motor.

6 Claims, 3 Drawing Figures

PROCESS FOR WINDING, ON A TAKE-UP SHAFT, A SHEET MATERIAL FED FROM A SUPPLY SOURCE

BACKGROUND OF THE INVENTION

The present invention relates to a process for winding, on a take-up shaft, a sheet material fed from a supply source, which process consists in taking up the sheet of material on an idler shaft and in driving this take-up shaft by means of a bearing drive cylinder rotating at the same linear speed as the feeder.

It may be, for example, a strip of material, such as a sheet of aluminum, paper, cardboard etc., coming from a wider strip cut longitudinally.

In the processes known at present, the strip is most often taken up on a drive shaft. Such driving at the center of the spool which is formed tends to constrict the successive turns of material, causing an uneven spool to be obtained.

Furthermore, it is necessary to continually readjust the rotational speed of the take-up shaft as the diameter of the spool which builds up increases.

To palliate these disadvantages, it has been proposed, for example in the German Pat. No. 578 713, to drive the spool which builds up by the periphery thereof.

In this case, the spool is driven by a roller bearing on its periphery. This roller is itself driven at the same speed as a feeder, formed from two drums between which the strip passes, a chain connection joining together the shaft of one of the drums of the feeder and the shaft of the roller.

With such a device, theoretically, the absence of drive at the center of the spool which builds up eliminates the irregularities in tightness of the turns.

Moreover, there is no longer an increase of torque to be compensated for since the diameter of the drive cylinder does not vary.

Means are not provided for acting solely on the roller in order to re-establish the identity of linear speed between this latter and the feeder, such identity being affected by such factors as the section or the nature of the driven material.

SUMMARY OF THE INVENTION

The aim of the present invention is to remedy this disadvantage, this aim being reached in this sense that it proposes driving the bearing cylinder through a friction means driven at an overspeed by a motor.

So that the bearing cylinder may rotate at the same speed as the feeder, the friction—adjustable—must be overcome and thus a continuous tension is ensured in the strip of material.

This process offers great flexibility as to the choice of tension and thus allows different materials, from the thickest to the thinnest, to be passed through the same machine, simply by adjusting the friction before starting up the operation, no re-adjustment being necessary during operation.

The winding under an appropriate and constant tension is advantageously optimized by the application of a controlled pressure between the bearing cylinder and the material being wound on the take-up shaft.

DESCRIPTION OF THE DRAWINGS

Embodiments of the process of the invention are described hereafter with reference to the accompanying drawing in which.

DESCRIPTION OF THE PREFERRED EMBODIMENTS

Figure 1:
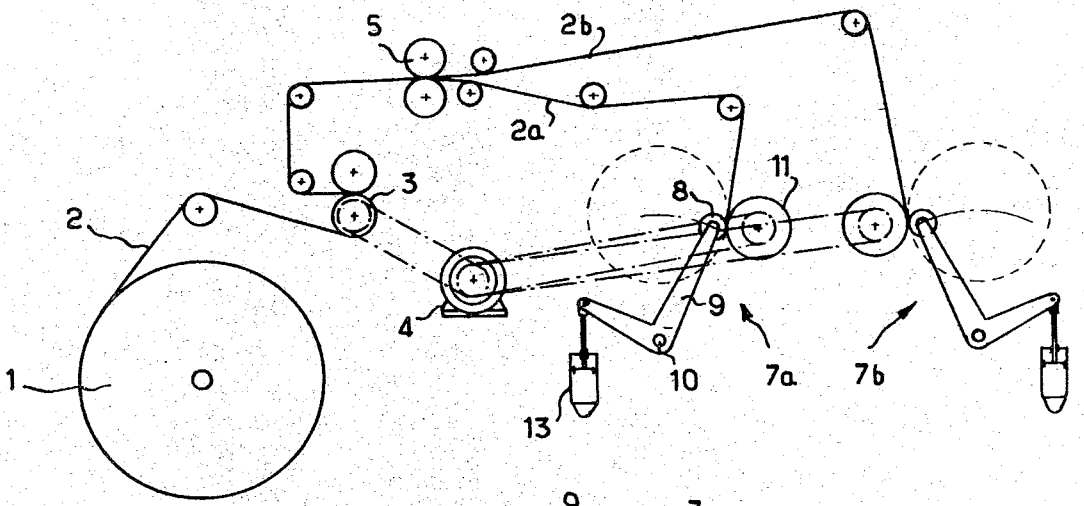
FIG. 1 is a schematical section of a machine applying a first embodiment of the process.
Figure 2:
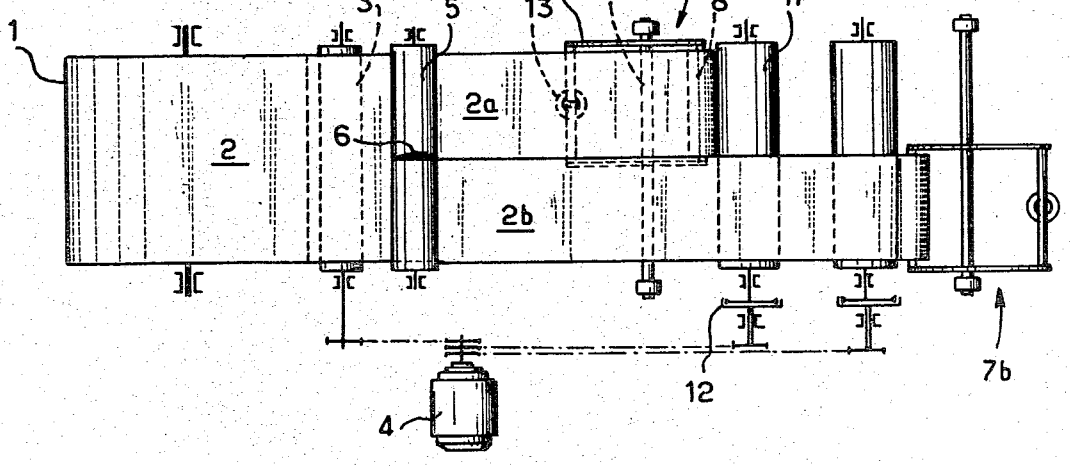
FIG. 2 is a top view of the machine of FIG. 1.

Referring to FIGS. 1 and 2 there can be seen a spool 1 supplying a sheet material 2 which is drawn therefrom by a feeder 3 driven by a motor 4. From feeder 3, the strip of material is fed to a circular cutting device 5 whose knife 6 can be seen in FIG. 2.

Strip 2 is cut therein longitudinally thus giving rise to two strips 2*a* and 2*b* which are separated and fed respectively to winding units 7*a* and 7*b*. Since these units are identical, only one of them will be described.

Winding unit 7*a* comprises, on the one hand, an idler takeup shaft 8 mounted at the end of arms 9 adapted to pivot about an axis 10, and on the other hand, a bearing cylinder 11 driven by motor 4 through a friction means 12 (FIG. 2).

Motor 4 drives the outer part of friction means 12 at an overspeed. By overcoming this friction, which is adjustable, bearing cylinder 11 is made to rotate at the same linear speed as feeder 3, thus ensuring a continuous tension in strip 2*a*.

More precisely, if motor 4 drives feeder 3 at a linear speed V, it will drive friction means 12, which may be among other things an electromagnetic powder coupler, at a speed equal, for example by construction, to 115%V and it is the friction means 12—adjusted with respect to the section of the material (thickness/length) and of the nature thereof—which will re-establish, for bearing cylinder 11, the desired linear speed V.

Thus tractive efforts going from 500 g/mm$^2$ for fine materials up to 1.5 kg/mm$^2$ for thick materials may be exerted, a tractive effort of 800 g to 1.2 kg/mm$^2$ being used for current materials.

As can be seen, the strip 2*a* drives tangentially the periphery of take-up shaft 8.

It will be readily understood that bearing cylinder 11 drives take-up shaft 8 which is applied thereagainst and that consequently strip 2*a* is wound around this take-up shaft. As the number of turns increases, the take-up shaft moves further away from the bearing cylinder, which is made possible by the pivoting of arms 9. The path of take-up shaft 8 and the final diameter of the spool formed are shown with a broken line.

A jack 13 acting on the pivoting arms 9 maintains a constant pressure of the spool being formed on bearing cylinder 11.

In practice, it is by adjusting the friction and the bearing pressure that the best result is obtained, a combination effect being exerted between these two means.

Figure 3:
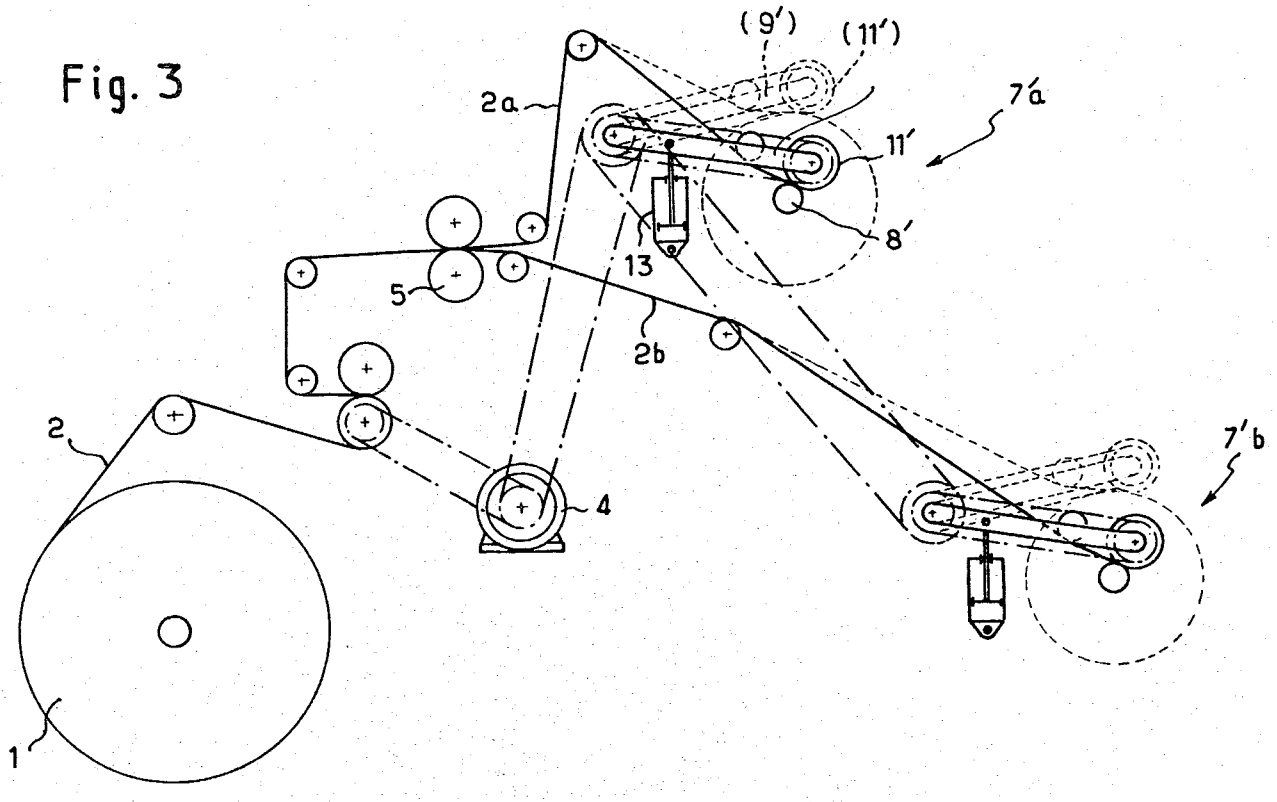
FIG. 3 is a schematical section of a machine applying a second embodiment of the process.

Referring to FIG. 3, another type of machine can be seen which differs from the preceding one only by the construction of the winding units.

In this case, it is bearing cylinder 11' which is mounted on the pivoting arms 9', the take-up shaft 8' being itself mounted on a fixed shaft. The final diameter of the spool formed and the corresponding position of the pivoting arms 9' and of bearing cylinder 11' are shown with a broken line.

It will be understood that the soluton described by way of example for moving apart the take-up shaft and the bearing cylinder, i.e. mounting on pivoting arms is not imperative. Recourse could be had, in fact, to any other equivalent means in the technical field.

Although two embodiments of cutting machines have been described above, it is clear that the application of the process of the invention is not limited to such machines.

What is claimed is:

1. A process for winding, on a take-up shaft, a sheet material fed at a selected linear speed from a supply source, which consists in taking up the sheet of material on an idler shaft and driving this take-up shaft by means of a bearing drive cylinder rotating at the selected linear speed of the supply source, wherein linear speed identity between the bearing cylinder and the supply source is obtained by driving the bearing drive cylinder by an adjustable friction means driven at overspeed with respect to the selected linear speed by a motor.

2. The process as claimed in claim 1, wherein, so as to exert a selected and constant tractive effort on the sheet of material being wound, the effect of the friction means driven at overspeed combines with that of means for applying a controlled pressure between the bearing cylinder and the sheet of material wound on the take-up shaft.

3. A device for winding a sheet of material, fed from a supply source at a selected linear speed, on an idler take-up shaft driven by means of a bearing cylinder rotating at the selected linear speed of the supply source, wherein the bearing cylinder is driven by adjustable friction means driven at overspeed with respect to the selected linear speed by a motor.

4. The device as claimed in claim 3, wherein means exerting a controlled pressure between the bearing cylinder and the sheet of material wound on the take-up shaft cooperate with the friction means to subject the sheet of material being wound up to a selected and constant tractive effort.

5. The device of claim 4 wherein the friction means comprises an electromagnetic powder coupler means.

6. The device of claim 5 wherein the means for applying the controlled pressure is a pressure cylinder mechanically linked to either the bearing cylinder or the idler take-up shaft.

* * * * *